US008869768B2

(12) United States Patent
Azevedo

(10) Patent No.: US 8,869,768 B2
(45) Date of Patent: Oct. 28, 2014

(54) PISTON INCLUDING A PAIR OF COOLING CHAMBERS

(71) Applicant: Federal-Mogul Corporation, Southfield, MI (US)

(72) Inventor: Miguel Azevedo, Ann Arbor, MI (US)

(73) Assignee: Federal-Mogul Corporation, Southfield, MI (US)

( * ) Notice: Subject to any disclaimer, the term of this patent is extended or adjusted under 35 U.S.C. 154(b) by 0 days.

(21) Appl. No.: 14/013,349

(22) Filed: Aug. 29, 2013

(65) Prior Publication Data

US 2014/0020640 A1 Jan. 23, 2014

Related U.S. Application Data

(63) Continuation of application No. 13/197,813, filed on Aug. 4, 2011, now Pat. No. 8,544,441.

(51) Int. Cl.
*F02F 3/22* (2006.01)

(52) U.S. Cl.
USPC ..... 123/193.6; 123/41.35

(58) Field of Classification Search
USPC ..... 123/193.6, 41.35
IPC ..... F02F 3/22
See application file for complete search history.

(56) References Cited

U.S. PATENT DOCUMENTS

| | | | | |
|---|---|---|---|---|
| 1,678,957 | A | 7/1928 | Otto | |
| 1,876,917 | A | 9/1932 | Fritz | |
| 2,494,748 | A | 1/1950 | Ernestus | |
| 3,730,163 | A | 5/1973 | Elsbett et al. | |
| 4,867,119 | A | 9/1989 | Cooper et al. | |
| 5,040,454 | A | 8/1991 | Ballheimer et al. | |
| 5,307,732 | A | 5/1994 | Berlinger | |
| 6,651,549 | B2 | 11/2003 | Zhu et al. | |
| 6,904,876 | B1 | 6/2005 | Hofbauer et al. | |
| 8,544,441 | B2 * | 10/2013 | Azevedo | 123/193.6 |
| 2005/0087153 | A1 | 4/2005 | Moon | |
| 2010/0258064 | A1 * | 10/2010 | Rebello | 123/41.35 |
| 2010/0275861 | A1 * | 11/2010 | Schneider | 123/41.35 |
| 2013/0206095 | A1 * | 8/2013 | Azevedo et al. | 123/193.6 |

FOREIGN PATENT DOCUMENTS

| | | | |
|---|---|---|---|
| JP | 62096763 | A | 5/1987 |
| JP | 4265451 | A | 9/1992 |

* cited by examiner

*Primary Examiner* — M. McMahon
(74) *Attorney, Agent, or Firm* — Robert L. Stearns; Dickinson Wright, PLLC

(57) ABSTRACT

A piston for an internal combustion engine including a piston body (20). The piston body (20) defines a first cooling chamber (46) that is sealed closed and contains a first cooling medium (48) other than air. During operation of the piston, the first cooling medium (48) extracts heat from the surrounding regions of the piston body (20) to cool the piston body (20). The piston body (20) also defines a second cooling chamber (50) adjacent to the first cooling chamber (46). A cooling oil (51) is projected into the second cooling chamber (50) and against the portion of the piston body (20) separating the first and second cooling chambers (46, 50) to extract heat from the first cooling medium (48). The cooling oil (51) is redirected within the second cooling chamber (50) to extract additional heat from the first cooling medium (48) or directly from the piston body (20).

15 Claims, 3 Drawing Sheets

PISTON INCLUDING A PAIR OF COOLING CHAMBERS

CROSS-REFERENCE TO RELATED APPLICATION

This Continuation application claims the benefit of U.S. Utility application Ser. No. 13/197,813, filed Aug. 4, 2011, which is incorporated herein by reference in its entirety.

BACKGROUND OF THE INVENTION

1. Field of the Invention

The invention is related generally to pistons for internal combustion engines, and more particularly to pistons having internal cooling chambers for cooling the pistons during operation.

2. Description of the Related Art

It is desirable for engine manufacturers to increase the temperature of the combustion of the air/fuel mixture in the combustion chamber of the cylinder in order to increase the fuel efficiency of the engine and decrease emissions. Therefore, there remains a significant and continuing need for improved pistons with cooling systems capable of allowing the piston to withstand increased temperatures.

However, with increased heat of combustion, there is a corresponding need to design pistons that can operate in such an environment. One approach has been to cool the upper region of the piston that is exposed to the heat of combustion by forming an open or a closed cooling chamber in the piston and directing a stream of cooling oil from below into the chamber to help extract some of the heat of combustion from the affected regions of the piston. Such a cooling approach, however, has its limits and may not be adequate or most efficient under all conditions. Another alternative approach has been to encapsulate a cooling medium, such as sodium, within a sealed chamber in the upper portion of the piston as the principle means to extract the heat of combustion from the piston. This too has its limits and cannot always adequately cool the piston with ever-increasing combustion temperatures.

SUMMARY OF THE INVENTION

According to an aspect of the present invention, a piston for an internal combustion engine comprises a piston body having first and second cooling chambers. The first chamber is sealed closed and contains a first cooling medium other than air for extracting heat from the surrounding regions of the piston body during operation of the piston. The second cooling chamber is disposed adjacent to the first cooling chamber and is at least partially open to receive a flow of cooling oil during operation of the piston to extract additional heat from the piston body.

One advantage of such a piston is the ability to operate at increased combustion temperatures. In operation, both the first cooling medium in the first cooling chamber and the cooling oil in the second cooling chamber extract heat from the piston body to allow the piston to operate in the high temperature environment. Further, at least some of the cooling oil in the second cooling chamber is directed to the portion of the piston body separating the first and second cooling chambers to extract heat from the first cooling medium. In other words, the cooling oil extracts heat from both the piston body and the first cooling medium. Thus, the effectiveness of the first cooling medium is increased by the cooling oil.

Another advantage of such a piston is the substantially uniform cooling of the top of the piston body, which is directly exposed to the high temperatures from the combustion of the air/fuel mixture in the combustion chamber. The uniform cooling reduces thermal stresses within the piston body, thus increasing the operating life of the piston body. The uniform cooling is additionally advantageous when the piston is employed in a diesel engine because hot spots in diesel engine pistons can lead to undesirable mono-nitrogen oxides ($NO_x$) generation.

According to another aspect of the invention, the first cooling medium in the first cooling chamber is of a material which is solid at ambient temperatures and melts at a predetermined temperature corresponding to an improved operating temperature of the engine. Such a fluid is advantageous because it allows the piston body to quickly warm to a more efficient operating temperature before the first operating medium melts and begins to cool the crown of the piston body in what is commonly referred to as the "cocktail shaker" effect. In other words, the time for the piston body to reach an increased operating temperature is reduced without compromising the cooling ability of the first cooling medium.

According to yet another aspect of the invention, the first cooling chamber is sealed closed, thus protecting the first cooling medium from contaminants and from oxidation, both of which could reduce the rate of cooling the piston.

BRIEF DESCRIPTION OF THE DRAWINGS

These and other features and advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
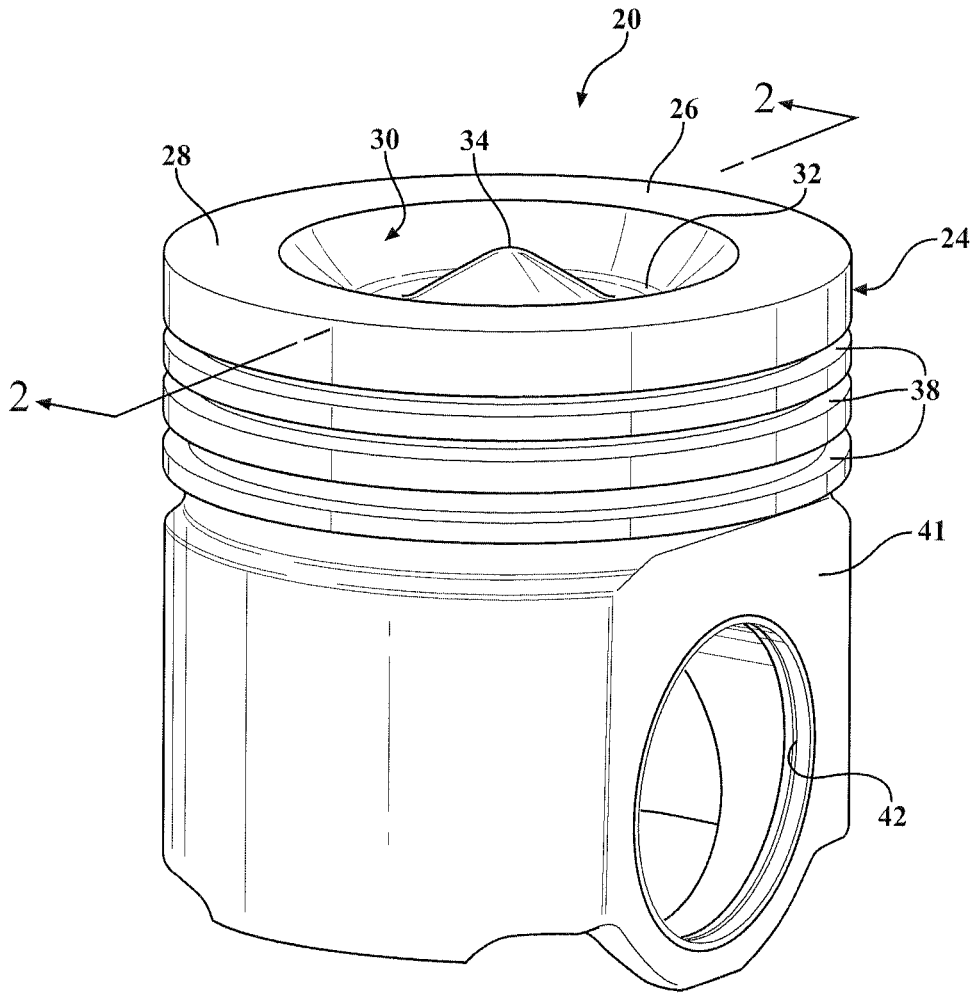
FIG. 1 is a perspective and elevation view of the piston of the exemplary embodiment.
Figure 2:
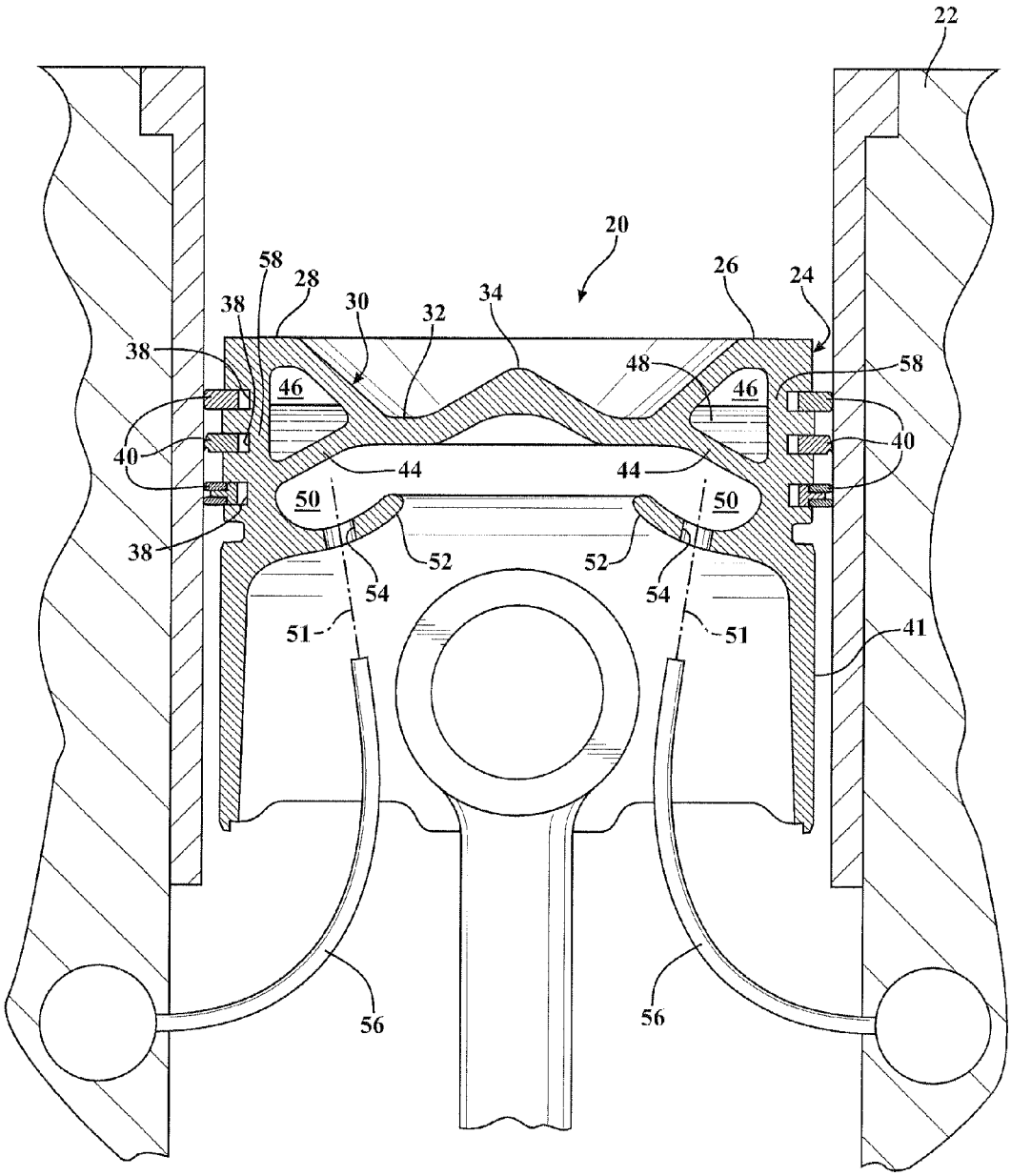
FIG. 2 is a cross-sectional view of the piston of the exemplary embodiment and taken along line 2-2 of FIG. 1.
Figure 3:
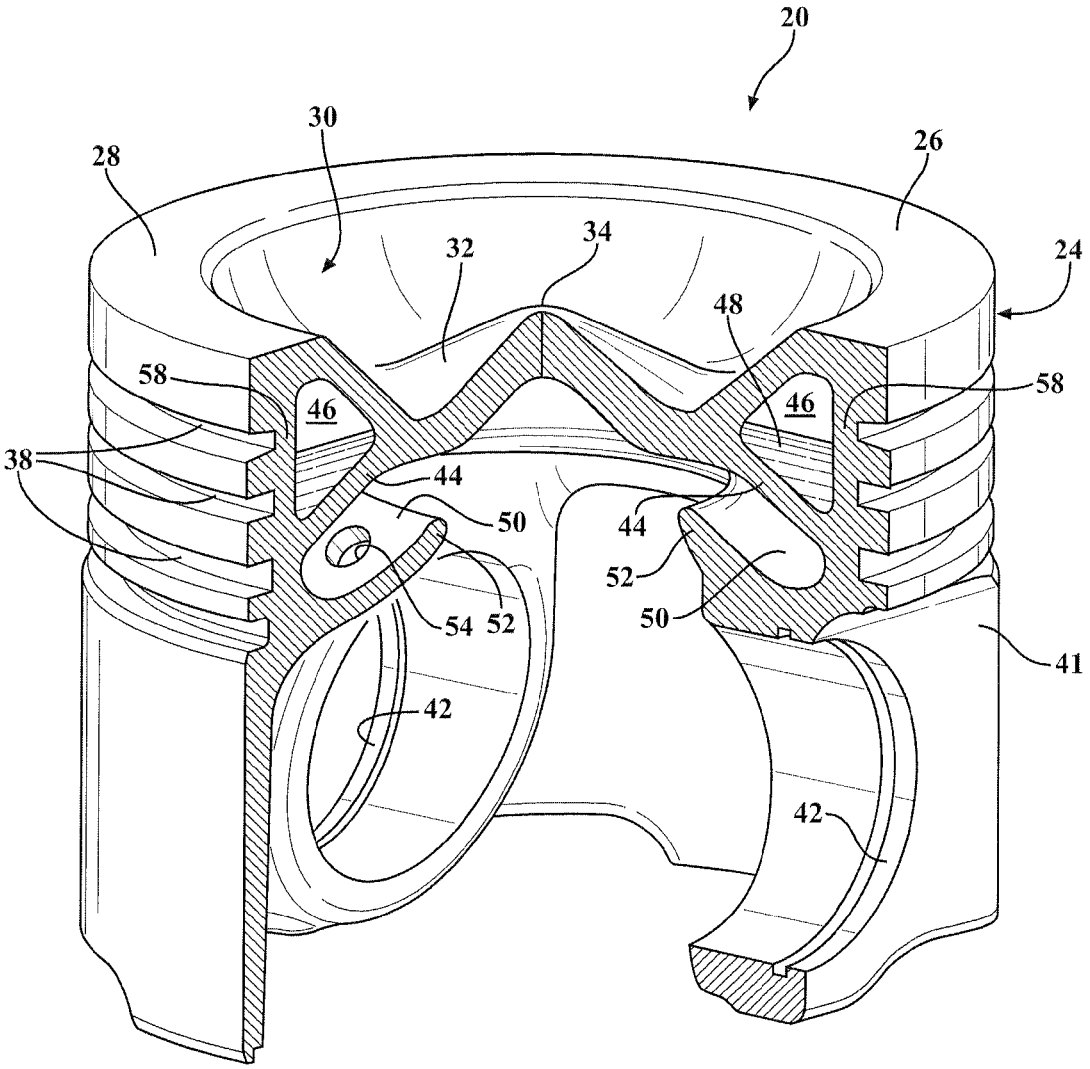
FIG. 3 is a perspective and elevation view, shown partly in section, of the piston of the exemplary embodiment.

Referring to the Figures, wherein like numerals indicate corresponding parts throughout the several views, a piston including a piston body 20 is generally shown in FIGS. 1-3. In the exemplary embodiment, the piston body 20 is for use in a compression-ignition, diesel engine block 22. However, it should be appreciated that the piston body 20 could be used in a wide range of other engines, e.g. spark-ignition gasoline engines.

As shown in FIG. 1, the piston body 20 includes a crown 24, generally indicated, disposed on an axis A and presenting a top surface 26. The top surface 26 has a flat outer periphery, which defines a bowl rim 28 and a combustion bowl 30 recessed from the bowl rim 28. The first cooling chamber 46 is disposed adjacent to the bowl rim 28. The combustion bowl 30 defines a trough 32 having a generally circular shape and a bullet nose 34 extending axially upwardly from the trough 32. The crown 24 could be of one piece or multiple pieces joined together, for example, through welding, as will be appreciated by those skilled in the art. If the crown 24 is of more than one piece, then the pieces can be made of different materials. This could be advantageous because the portion of the crown 24 exposed to the combustion chamber of the cylinder could be of a more thermally resistant material, and the remainder of the crown 24 could be of a less thermally resistant material.

As shown in FIGS. 2 and 3, the crown 24 also includes an outer wall 58 depending from the top surface 26. Preferably, the outer wall 58 extends perpendicular to the top surface 26, and the first cooling chamber 46 is disposed along the top surface 26 and the outer wall 58 of the upper crown 24.

The outer wall 58 of the upper crown 24 defines at least one annular groove 38 and typically a plurality of annular grooves 38 spaced axially from one another. As shown in FIG. 2, the annular grooves 38 are disposed adjacent to the first cooling chamber 46 and at least one piston ring 40 is disposed in each of the grooves 38 for sealing the crown 24 to the engine block 22. In operation, the top surface 26 of the crown 24 is generally the hottest portion of the piston body 20 because it is exposed to the combustion of the fuel/air mixture in the combustion chamber of the cylinder. Therefore, the piston ring 40 which is closest to the top surface 26 can be of a material resistant to higher temperatures than the other piston rings 40. However, the piston rings 40 could all be made of the same material. The exemplary embodiment includes three piston rings 40; however, it should be appreciated that any desirable number of piston rings 40 could be employed.

In the exemplary embodiment, the piston body 20 is a monobloc piston body 20, i.e. the piston body 20 includes a skirt 41 integrally formed with or secured to at least the bottom of the crown 24. The skirt 41 could be secured to the crown 24 through friction welding, for example. Alternately, the skirt 41 could be hingedly connected to the crown 24 with a pin (not shown). In the exemplary embodiment, the skirt 41 has a generally cylindrical shape and extends axially downward from the bowl rim 28 of the top surface 26. The skirt 41 presents a pair of diametrically opposed bosses 42 spaced axially from the piston rings 40, and the bosses 42 are sized to receive a pin (not shown) to connect the skirt 41 to a piston rod (not shown), as will be appreciated by those skilled in the art.

As best shown in FIG. 2, the piston body 20 of the exemplary embodiment further includes an inner wall 44 extending from the side of the crown 24 to the underside of the combustion bowl 30 to define a first cooling chamber 46. The first cooling chamber 46 is spaced radially inward of the piston rings 40 and axially below the bowl rim 28. The inner wall 44 is also preferably disposed at an angle relative to the outer wall 58, as shown in FIGS. 2 and 3.

A first cooling medium 48 other than air is disposed in the first cooling chamber 46 for extracting heat from the surrounding regions of the piston body 20. Specifically, in the exemplary embodiment, the first cooling medium extracts heat from the top surface 26 of the crown 24 and from the piston rings 40. In operation, reciprocation of the piston body 20 within the cylinder of the engine block 22 causes the first cooling medium 48 to be shaken within the first cooling chamber 46 in what is generally known as the "cocktail shaker" effect. In other words, the first cooling medium 48 gets shaken up and down within the first cooling chamber 46 and extracts heat from the top surface 26 of the crown 24 with each collision against the top of the first cooling chamber 46. Preferably, the first cooling medium 48 is disposed in approximately thirty to fifty percent of the first cooling chamber 46 to maximize the effectiveness of the "cocktail shaker" effect. By cooling the top surface 26 of the crown 24, the first cooling medium 48 prevents oxidation of the bowl rim 28 and substantially equalizes the temperature around the circumference of the top surface 26 of the crown 24.

In the exemplary embodiment, the first cooling chamber 46 is hermetically sealed closed, and therefore, the first cooling medium 48 is protected from contamination and from oxidation. It should be appreciated that the first cooling chamber 46 could take many different sizes and shapes other than those shown in the Figures. For example, the first cooling chamber 46 could be substantially disposed only adjacent to the bowl rim 28 of the crown 24, or the first cooling chamber 46 could extend downwardly past each of the piston rings 40 for cooling all of the piston rings 40.

Many engines, but particularly diesel engines, operate most efficiently at higher temperatures and pressures. In the exemplary embodiment, the first cooling medium 48 has a melting point temperature of between fifty and two hundred degrees Celsius (50-200° C.) to increase the efficiency of the engine. Most preferably, the first cooling medium 48 is of sodium or a sodium-based compound having a melting point temperature of approximately one hundred degrees Celsius (100° C.). In operation, the sodium 48 remains solid until it reaches the 100° C. melting point, i.e. after the piston body 20 has reached a more efficient operating temperature. Upon reaching the melting point, the sodium 48 melts and the "cocktail shaker" effect described above begins to increase the cooling of the top surface 26 of the crown 24 and the piston rings 40. Because this increased cooling only starts after the sodium 48 melts, the time that the piston 20 spends at the less efficient low temperatures is reduced. It should be appreciated that the first cooling medium could alternately be lithium, a lithium-based compound, silicone oil or any other cooling medium. It may be desirable to select the first cooling medium 48 as a function of the most efficient operating temperature of the piston 20.

The piston body 20 further includes a second cooling chamber 50 adjacent to the first cooling chamber 46. The second cooling chamber 50 is at least partially open to receive a cooling oil 51 into the second cooling chamber 50 during operation of the piston to extract additional heat from the piston body 20. In the exemplary embodiment, the second cooling chamber 50 is defined by a flange 52 spaced axially from and aligned with the inner wall 44 of the first cooling chamber 46. In other words, the first and second cooling chambers 46, 50 are separated by the inner wall 44. The flange 52 curves axially upward toward the top surface 26 of the crown 24 to an end that is axially below the combustion bowl 30 of the crown 24 to define a dish-tray shape, as best shown in FIG. 3. As best shown in FIG. 2, the second cooling chamber 50 is bounded on three sides by the flange 52, combustion bowl 30 and the inner wall 44 and is open in the radial direction.

As shown in FIG. 2, the exemplary flange 52 defines a plurality of apertures 54. A plurality of nozzles 56 are mounted on the engine block 22, and each nozzle 56 is aimed to project the cooling oil 51 through an aperture 54 of the flange 52 whenever the piston body 20 is in a bottom-dead-center position. The nozzles 56 are fluidly connected to a fluid reservoir (not shown). In operation, the nozzles 56 project a cooling oil 51 through the apertures 54 of the flange 52 to collide with the inner wall 44 separating the enclosed and second cooling chambers 46, 50. Heat is extracted from the first cooling medium 48 through the inner wall 44 to the cooling oil 51. Thus, the first cooling medium 48 in the first cooling chamber 46 is cooled by the cooling oil 51. The cooling oil 51 is then shaken within the dish-tray shaped second cooling chamber 50 through the "cocktail shaker" effect described above to extract additional heat from the piston body 20 and/or the first cooling medium 48. The curvature of the flange 52 of the exemplary embodiment redirects some of the cooling oil 51 against the underside of the bullet nose 34 of the combustion chamber of the crown 24 to cool the top surface 26 of the crown 24. Together, the first cooling medium 48 and the cooling oil 51 substantially uniformly cool the top surface 26 of the crown 24. Eventually, the cooling oil 51 falls out of the second cooling chamber 50 and into the fluid reservoir (not shown). In the fluid reservoir, the cooling oil 51 may then be cooled and projected back against the inner wall 44 separating the first and second cooling chambers 46, 50 by the nozzles 56 in a closed-loop fashion. The cooling oil 51 could be an oil or any other desirable fluid.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

What is claimed is:

1. A piston for an internal combustion engine, comprising:

a piston body having a first cooling chamber that is sealed closed and contains therein a first cooling medium other than air;

a second cooling chamber disposed adjacent said first cooling chamber and which is open in a radial direction to receive a flow of cooling oil into said second cooling chamber, wherein said piston body includes an inner wall separating said first cooling chamber from said second cooling chamber for transferring heat from the first cooling medium contained in said first cooling chamber to the cooling oil received in said second cooling chamber; and a flange spaced axially from and aligned radially with said inner wall to define said second cooling chamber.

2. The piston as set forth in claim 1 wherein said piston body includes an upper crown presenting a top surface and an outer wall depending from said top surface; said wherein said first cooling chamber is disposed along said top surface and said outer wall of said upper crown.

3. The piston as set forth in claim 2 wherein said flange curves axially upward toward said top surface.

4. The piston as set forth in claim 2 wherein said inner wall is disposed at an angle relative to said outer wall.

5. The piston as set forth in claim 4, wherein said outer wall extends perpendicular to said top surface.

6. The piston as set forth in claim 2 wherein said outer wall includes at least one annular groove adjacent to said first cooling chamber for receiving a piston ring.

7. The piston as set forth in claim 2 wherein said top surface has a flat outer periphery to define a bowl rim and said first cooling chamber is disposed adjacent to said bowl rim.

8. The piston as set forth in claim 1 wherein the first cooling medium has a melting point of between fifty and two hundred degrees Celsius.

9. A method of cooling a piston in an internal combustion engine, comprising the steps of:

providing a piston body including a first cooling chamber and a second cooling chamber adjacent the first cooling chamber, wherein the second cooling chamber is open in a radial direction to receive a flow of cooling oil into the second cooling chamber during operating of the piston, the piston body defines an inner wall separating the first cooling chamber from the second cooling chamber, and the piston body includes a flange spaced axially from the inner wall and aligned radially with the inner wall to define the second cooling chamber; and sealing a first cooling medium other than air in the first cooling chamber for extracting heat from the surrounding regions of the piston body.

10. The method as set forth in claim 9 including transferring heat from the first cooling medium to the cooling oil through the inner wall separating the first cooling chamber from the second cooling chamber.

11. The method as set forth in claim 9 further including the step of projecting the cooling oil into the second cooling chamber to extract heat from the piston body and the first cooling medium.

12. The method as set forth in claim 9 further including the step of shaking the first cooling medium within the first cooling chamber to transfer heat from the piston body to the first cooling medium.

13. The method as set forth in claim 9 wherein the piston body includes an upper crown presenting a top surface and an outer wall depending from the top surface; the first cooling chamber is disposed along the top surface and the outer wall of the upper crown; the outer wall extends perpendicular to the top surface; the inner wall extends at an angle relative to the outer wall; and the flange curves axially upward toward the top surface.

14. The method as set forth in claim 13 wherein the outer wall of the upper crown includes at least one annular groove adjacent to the first cooling chamber for receiving a piston ring; the top surface has a flat outer periphery to define a bowl rim; and the first cooling chamber is disposed adjacent to the bowl rim.

15. The method as set forth in claim 9 wherein the first cooling medium has a melting point of between fifty and two hundred degrees Celsius.

* * * * *